US009443486B2

(12) United States Patent
Liu et al.

(10) Patent No.: US 9,443,486 B2
(45) Date of Patent: Sep. 13, 2016

(54) DRIVING CIRCUIT OF DISPLAY PANEL AND DRIVING MODULE THEREOF, AND DISPLAY DEVICE AND METHOD FOR MANUFACTURING THE SAME

(71) Applicant: SITRONIX TECHNOLOGY CORP., Hsinchu County (TW)

(72) Inventors: Ping Lin Liu, Hsinchu County (TW); Shih Chieh Hung, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 14/157,711

(22) Filed: Jan. 17, 2014

(65) Prior Publication Data

US 2014/0368485 A1 Dec. 18, 2014

Related U.S. Application Data

(60) Provisional application No. 61/835,721, filed on Jun. 17, 2013.

(51) Int. Cl.
*G09G 3/36* (2006.01)

(52) U.S. Cl.
CPC ..... *G09G 3/3674* (2013.01); *G09G 3/3696* (2013.01); *G09G 2310/02* (2013.01); *G09G 2310/0289* (2013.01); *Y10T 29/4913* (2015.01)

(58) Field of Classification Search
CPC ..... G09G 3/3674; G09G 3/3677; G09G 2300/021; G09G 2330/02; G09G 3/3648; G09G 3/3688; G09G 2310/0289; G09G 2310/02; Y10T 29/4913
See application file for complete search history.

(56) References Cited

U.S. PATENT DOCUMENTS

2006/0158412 A1* 7/2006 Morita ..... G09G 3/3655 345/94
2008/0036529 A1* 2/2008 Ishiyama ..... H02M 3/07 327/536
2008/0284393 A1* 11/2008 Panov ..... G05F 1/56 323/280
2009/0237131 A1* 9/2009 Shin ..... H03L 7/0893 327/157
2011/0069044 A1* 3/2011 Lee et al. ..... 345/204

(Continued)

FOREIGN PATENT DOCUMENTS

CN 101814265 A 8/2010
CN 102622980 A 8/2012

(Continued)

*Primary Examiner* — Ilana Spar
*Assistant Examiner* — Mihir Rayan
(74) *Attorney, Agent, or Firm* — Rosenberg, Klein & Lee

(57) ABSTRACT

The present invention relates to a driving circuit for a display panel and the driving module thereof and a display device and the method for manufacturing the same. The present invention comprises a power generating module, a plurality of signal generating units, a power generating circuit, and a scan control circuit. The power generating module generates a supply power source according to an input power source. The plurality of signal generating units are coupled to the power generating module and generate a plurality of control signals according to the supply power source and a plurality of input signals. The power generating circuit generates a driving power source. The scan control circuit is coupled to the power generating circuit and the plurality of signal generating unit, and generates a plurality of scan signals according to the driving power source and at least one of the plurality of control signals.

20 Claims, 14 Drawing Sheets

(56) References Cited

U.S. PATENT DOCUMENTS

| | | | | |
|---|---|---|---|---|
| 2014/0049459 | A1* | 2/2014 | Liao | 345/90 |
| 2014/0192094 | A1* | 7/2014 | Liao | G09G 3/3696 345/690 |
| 2014/0192095 | A1* | 7/2014 | Liao | G09G 3/3688 345/690 |
| 2014/0368485 | A1* | 12/2014 | Liu et al. | 345/211 |
| 2015/0048743 | A1* | 2/2015 | Liao | G09G 3/36 315/161 |

FOREIGN PATENT DOCUMENTS

| | | | |
|---|---|---|---|
| CN | 203644376 | U | 6/2014 |
| JP | 2001-324968 | A | 11/2001 |
| JP | 2002-318566 | A | 10/2002 |
| JP | 2003-216125 | A | 7/2003 |
| JP | 2003-270660 | A | 9/2003 |
| JP | 2004-354158 | A | 12/2004 |
| JP | 2005-10282 | A | 1/2005 |
| JP | 2011-154386 | A | 8/2011 |
| TW | 200725065 | | 7/2007 |
| TW | M408885 | | 8/2011 |
| TW | 201222521 | | 6/2012 |
| TW | 201225036 | A | 6/2012 |
| TW | M474933 | U | 3/2014 |

* cited by examiner

DRIVING CIRCUIT OF DISPLAY PANEL AND DRIVING MODULE THEREOF, AND DISPLAY DEVICE AND METHOD FOR MANUFACTURING THE SAME

REFERENCE TO RELATED APPLICATION

This Application is based on Provisional Patent Application Ser. No. 61/835,721, filed 17 Jun. 2013.

FIELD OF THE INVENTION

The present invention relates generally to a driving circuit and the driving module thereof and a display device and the method for manufacturing the same, and particularly to a driving circuit for a display panel and the driving module thereof and a display device and the method for manufacturing the same capable of reducing the area of capacitors.

BACKGROUND OF THE INVENTION

Modern technologies are developing prosperously. Novel information products are introduced daily for satisfying people's various needs. Early displays are mainly cathode ray tubes (CRTs). Owing to their huge size, heavy power consumption, and radiation hazardous to the heath of long-term users, traditional CRTs are gradually replaced by liquid crystal displays (LCDs). LCDs have the advantages of small size, low radiation, and low power consumption, and thus becoming the mainstream in the market.

Please refer to FIG. 1, which shows a schematic diagram of the driving circuit of the display panel according to the prior art. As shown in the figure, the driving circuit of the display panel according to the prior art comprises a driving chip 10 and a scan control circuit 301 disposed on a display panel 30. The driving chip 10 comprises a plurality of signal generating unit 101 and a plurality of charge pumps 103, 105. The plurality of signal generating units 101 receive a plurality of input signals $IS_1$~$IS_n$, respectively, and generate a plurality of control signals $CS_1$~$CS_n$ according to the plurality of input signals $IS_1$~$IS_n$, respectively. In addition, the plurality of signal generating units 101 receive the driving voltage $V_{GH}$ output by the charge pump 103 and driving voltage $V_{GL}$ output by charge pump 105 concurrently and uses them as the power sources for the plurality of control signals $CS_1$~$CS_n$.

The plurality of control signals $CS_1$~$CS_n$ are output to the control circuit 301. The scan control circuit 301 selects at least one of the plurality of control signals $CS_1$~$CS_n$ and outputs a plurality of scan signal $SC_1$~$SC_m$ to the pixels of the display panel 30 according to at least one of the plurality of control signals $CS_1$~$CS_n$. Meanwhile, the scan control circuit 301 also receives the driving voltages $V_{GH}$, $V_{GL}$ and uses them as the power sources for the plurality of control signals $CS_1$~$CS_n$.

Nonetheless, in the driving circuit for a display panel according to the prior art as described above, the driving voltages $V_{GH}$, $V_{GL}$ output by the charge pumps 103, 105 are supplied to the plurality of signal generating unit 101 and the scan control circuit 301 simultaneously. Thereby, the charge pumps 103, 105 need to have large output power, which requires voltage-stabilizing capacitors $C_{R1}$, $C_{R2}$ having large capacitance coupled at the outputs for stabilizing the voltage levels of the driving voltages $V_{GH}$, $V_{GL}$, as well as avoiding influences on the plurality of control signals $CS_1$~$CS_n$ generated by the plurality of signal generating units 101 due to variations in the driving voltages $V_{GH}$, $V_{GL}$ as the loading (the scan control circuit 301) changes. Moreover, because the voltage-stabilizing capacitors $C_{R1}$, $C_{R2}$ cannot be integrated in the driving chip 10 owing to their large capacitance, they are generally disposed on a flexible printed circuit (FPC) 50. Nonetheless, disposing the voltage-stabilizing capacitors $C_{R1}$, $C_{R2}$ having large capacitance and the FOC 50 increases the circuit area substantially, leading to an increase in cost.

Accordingly, the present invention provides a driving circuit for a display panel and the driving module thereof, and a display device and the method for manufacturing the same. According to the present invention, no voltage-stabilizing capacitor is required, and hence the problems described above can be solved.

SUMMARY

An objective of the present invention is to provide a driving circuit for a display panel and the driving module thereof, and a display device and the method for manufacturing the same. According to the present invention, a power generating circuit and a power generating module supply power sources to the signal generating unit and the scan control circuit, respectively, and thus enabling the signal generating unit and the scan control circuit not to share the same power source. Thereby, the output power of the power generating circuit is reduced; the size of the voltage-stabilizing capacitor at the output of the power generating circuit can be shrunk or even no voltage-stabilizing capacitor is required, leading to saving in circuit area.

Another objective of the present invention is to provide a driving circuit for a display panel and the driving module thereof, and a display device and the method for manufacturing the same. According to the present invention, a plurality of power generating modules are disposed for supplying power sources to a plurality of signal generating unit, respectively. When there are unused signal generating units, the corresponding power generating modules can be turned off for achieving the effect of saving power consumption.

In order to achieve the objectives and effects described above, the present invention discloses a driving circuit for a display panel, which comprises a power generating module, a plurality of signal generating units, a power generating circuit, and a scan control circuit. The power generating module receives an input power source and generates a supply power source according to the input power source. The plurality of signal generating units are coupled to the power generating module and generate a plurality of control signals according to the supply power source and a plurality of input signals. The power generating circuit generates a driving power source. The scan control circuit is coupled to the power generating circuit and the plurality of signal generating unit, and generates a plurality of scan signals according to the driving power source and at least one of the plurality of control signals.

The present invention further discloses a driving circuit for a display panel, which comprises a plurality of power generating modules, a plurality of signal generating units, a power generating circuit, and a scan control circuit. The plurality of power generating modules receive an input power source and generate a plurality of supply power sources according to the input power source. The plurality of signal generating units are coupled to the plurality of power generating modules and generate a plurality of control signals according to the plurality of supply power sources and a plurality of input signals. The power generating circuit generates a driving power source. The scan control circuit is coupled to the power generating circuit and the plurality of signal generating unit, and generates a plurality of scan signals according to the driving power source and at least one of the plurality of control signals.

The present invention further discloses a driving module for a display panel, which comprises an FPC and a driving chip. The FPC is connected electrically with a display panel. The driving chip is disposed on one side of the FPC, and comprises a power generating module, a plurality of signal generating units, a power generating circuit, and a scan control circuit. The power generating module receives an input power source and generates a supply power source according to the input power source. The plurality of signal generating units are coupled to the power generating module and generate a plurality of control signals according to the supply power source and a plurality of input signals. The power generating circuit generates a driving power source. The scan control circuit is coupled to the power generating circuit and the plurality of signal generating unit, and generates a plurality of scan signals according to the driving power source and at least one of the plurality of control signals.

The present invention further discloses a display device, which comprises an FPC and a driving chip. The FPC is connected electrically with a display panel. The driving chip is disposed on one side of the FPC, and generates a plurality of scan signals to the display panel. The driving chip comprises a power generating module, a plurality of signal generating units, a power generating circuit, and a scan control circuit. The power generating module receives an input power source and generates a supply power source according to the input power source. The plurality of signal generating units are coupled to the power generating module and generate a plurality of control signals according to the supply power source and a plurality of input signals. The power generating circuit generates a driving power source. The scan control circuit is coupled to the power generating circuit and the plurality of signal generating unit, and generates a plurality of scan signals according to the driving power source and at least one of the plurality of control signals.

The present invention further discloses a method for manufacturing a display device, which comprises steps of providing a display panel, an FPC, and a driving chip; disposing the driving chip on the display panel; and disposing the FPC on the display panel and connecting electrically the FPC with the driving chip. According to the present method, no voltage-stabilizing capacitor is required on the FPC.

DETAILED DESCRIPTION

In the specifications and subsequent claims, certain words are used for representing specific devices. A person having ordinary skill in the art should know that hardware manufacturers might use different nouns to call the same device. In the specifications and subsequent claims, the differences in names are not used for distinguishing devices. Instead, the differences in functions are the guidelines for distinguishing. In the whole specifications and subsequent claims, the word "comprising" is an open language and should be explained as "comprising but not limited to". Beside, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

In order to make the structure and characteristics as well as the effectiveness of the present invention to be further understood and recognized, the detailed description of the present invention is provided as follows along with embodiments and accompanying figures.

Figure 2:
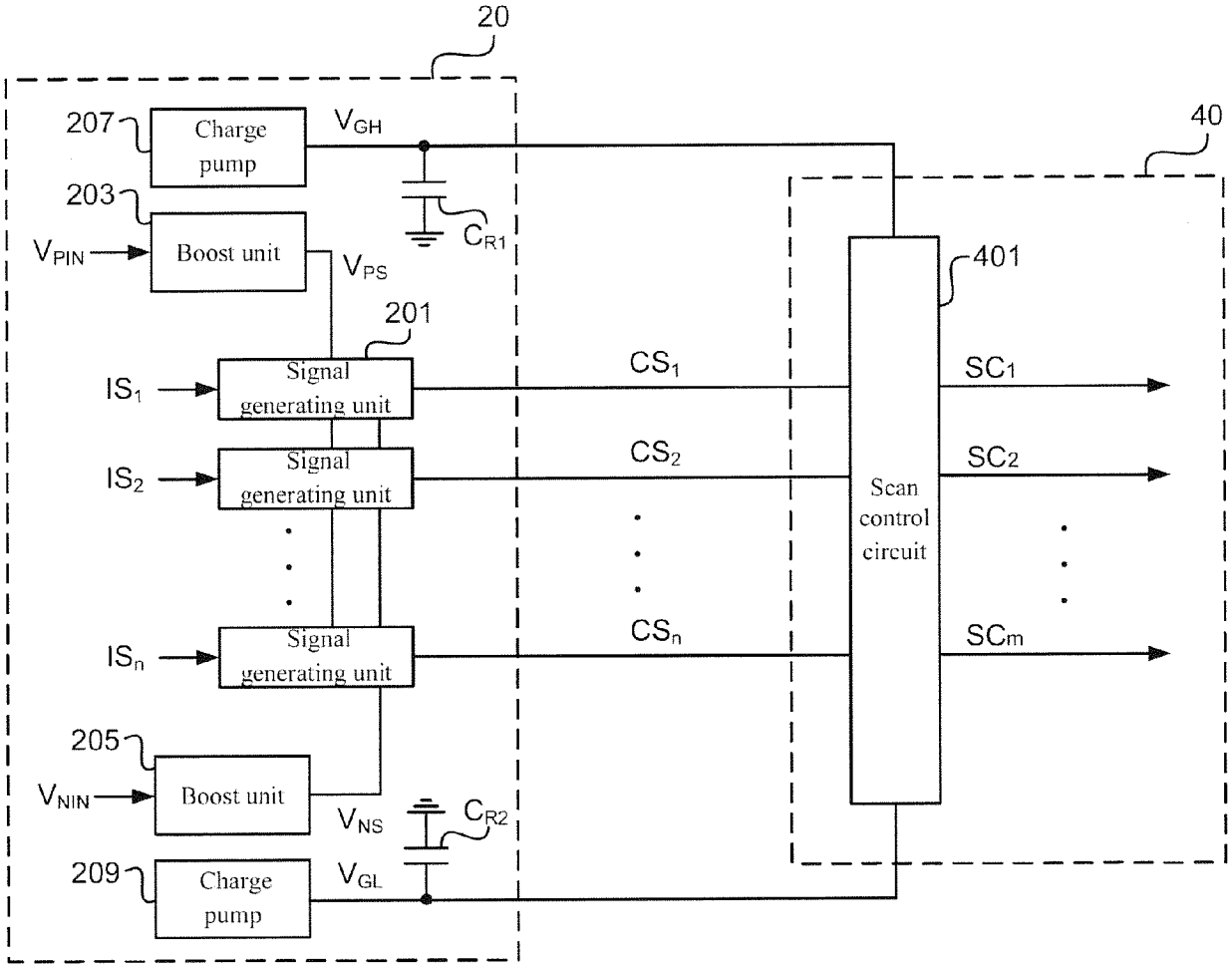
FIG. 2 shows a schematic diagram of the driving circuit of the display panel according to the first embodiment of the present invention.

Please refer to FIG. 2, which shows a schematic diagram of the driving circuit of the display panel according to the first embodiment of the present invention. As shown in the figure, the driving circuit of the display panel comprises a driving chip 20 and a scan control circuit 401 disposed on a display panel 40. The driving chip 20 comprises a power generating module, a power generating circuit, and a plurality of signal generating units (Gate in Panel, GIP) 201. The power generating module generates a supply power source according to an input power source and outputs the supply power source to the plurality of signal generating units 201. According to the present embodiment, the power generating module comprises a plurality of boost units 203, 205. The boost unit 203 receives the input power source and generates a supply voltage $V_{PS}$ of the supply power source according to an input voltage $V_{PIN}$ of the input power source. The boost unit 205 receives the input power source and generates a supply voltage $V_{NS}$ of the supply power source according to an input voltage $V_{NIN}$ of the input power source. The voltage level of the supply voltage $V_{PS}$ is higher than that of the supply voltage $V_{NS}$.

The power generating circuit is used for generating a driving power source and outputting the driving power source to the scan control circuit 401. The power generating circuit comprises a plurality of charge pumps 207, 209. The charge pump 207 is used for generating a driving voltage $V_{GH}$ of the driving power source; the charge pump 209 is used for generating a driving voltage $V_{GL}$ of the driving power source. The voltage level of driving voltage $V_{GH}$ is higher than that of the driving voltage $V_{GL}$.

The plurality of signal generating units 201 can be a level shifter, and generates a plurality of control signal $CS_1$~$CS_n$ according to a plurality of input signals $IS_1$~$IS_n$. In addition, the plurality of signal generating units 201 are coupled to the boost unit 203, 205, respectively. The supply voltages $V_{PS}$, $V_{NS}$ are used as the supply power sources of the plurality of control signals $CS_1$~$CS_n$, respectively.

The scan control circuit 401 is coupled to the plurality of signal generating units 201 and the charge pumps 207, 209 of the power generating circuit, and selects at least one of the required plurality of control signals $CS_1$~$CS_n$ as the signal for generating a plurality of scan signals $SC_1$~$SC_m$. The plurality of scan signals $SC_1$~$SC_m$ are output to the pixels of the display panel 40 for scanning the display panel 40. Besides, the scan control circuit 401 further receives the driving voltages $V_{GH}$, $V_{GL}$ as the power sources for operating the plurality of scan signals $SC_1$~$SC_m$. The technology of how the scan control circuit 401 generates the plurality of scan signals according to at least one of the plurality of control signals $CS_1$~$CS_n$ for scanning the display panel 40 is well known to a person having ordinary skill in the art. Hence, the details will not be described further.

The boost units 203, 205 can be a charge pump, a boost circuit, or a low dropout regulator (LDO), respectively, for boosting or stabilizing the input voltages $V_{PIN}$, $V_{NIN}$ of the input power source and generating the supply voltages $V_{PS}$, $V_{NS}$. In addition, the input voltages $V_{PIN}$, $V_{NIN}$ can be supplied by charge pumps, boost circuits, LDOs, or any other power circuits according to the prior art.

It is known according to the above description that the driving circuit for a display panel according to a preferred embodiment of the present invention uses the power generating modules (the boost units 203, 205) and the power generating circuit (the charge pumps 207, 209), so that the power generating modules can provide the supply power sources (the supply voltage $V_{PS}$, $V_{NS}$) required by the plurality of signal generating units 201. In addition, the power generating circuit provides the driving power sources (the driving voltage $V_{GH}$, $V_{GL}$) required by the scan control circuit 401, so that the plurality signal generating units 201 and the scan control circuit 401 can have their respective supply power sources, and thus reducing the loading of the power generating circuit as well as the required output power of the charge pumps 207, 209 of the power generating circuit. Thereby, the capacitance of the stabilizing capacitors $C_{R1}$, $C_{R2}$ disposed at the outputs of the charge pumps 207, 209 can be lowered and hence shrinking the size of the stabilizing capacitors $C_{R1}$, $C_{R2}$. Accordingly, the stabilizing capacitors $C_{R1}$, $C_{R2}$ can be integrated in the driving chip 20. Alternatively, the stabilizing capacitors $C_{R1}$, $C_{R2}$ are not required for reducing the circuit area.

Figure 3:
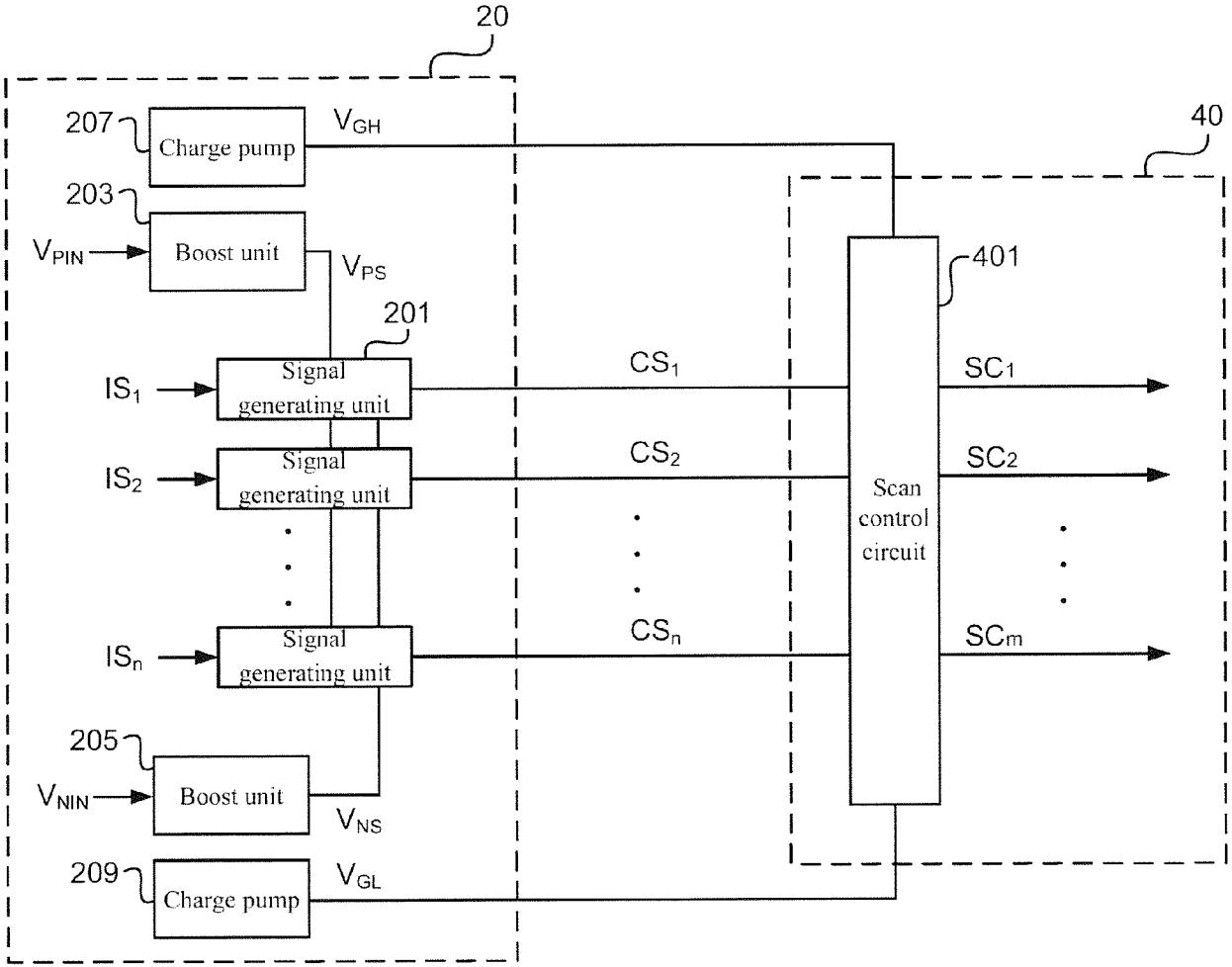
FIG. 3 shows a schematic diagram of the driving circuit of the display panel according to the second embodiment of the present invention.

Please refer to FIG. 3, which shows a schematic diagram of the driving circuit of the display panel according to the second embodiment of the present invention. As shown in the figure, the difference between the present embodiment and the one in FIG. 2 is that according to the present embodiment, it is not required that the output of the driving chip 20 used for outputting the driving voltages $V_{GH}$, $V_{GL}$ should be connected with the stabilizing capacitors $C_{R1}$, $C_{R2}$; it is not required that the path for outputting the driving voltages $V_{GH}$, $V_{GL}$ to the scan control circuit 401 by the driving chip 20 should be connected with the stabilizing capacitors $C_{R1}$, $C_{R2}$; or it is not required that the input of the scan control circuit 401 used for receiving the driving voltages $V_{GH}$, $V_{GL}$ should be connected with the stabilizing capacitors $C_{R1}$, $C_{R2}$.

Besides, because the plurality of signal generating units 201 and the scan control circuit 401 have respective supply power sources, the influence of variations in levels of the driving voltages $V_{GH}$, $V_{GL}$ as the loading (the display panel 40) changes on the plurality of control signals $CS_1$~$CS_n$ generated by the plurality of signal generating units 201. Thereby, the scan control circuit 401 can generate the plurality of control signals $CS_1$~$CS_n$ stably.

Furthermore, the power generating circuit according to the present embodiment includes the charge pumps 207, 209. Nonetheless, the present invention is not limited to the embodiment. The charge pumps 207, 209 can be replaced by boost circuits, LDOs, or any other boost circuits.

Figure 1:
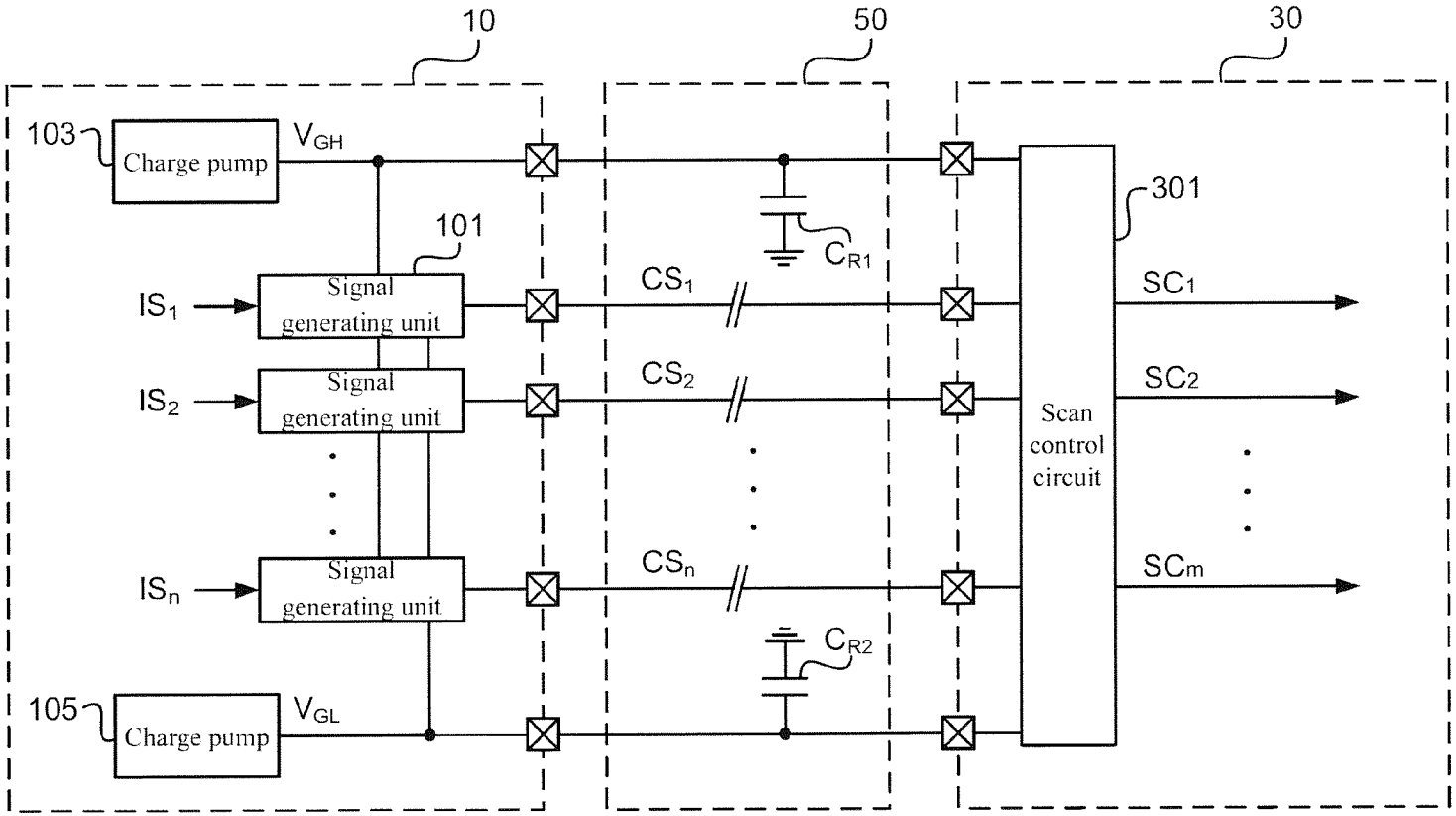
FIG. 1 shows a schematic diagram of the driving circuit of the display panel according to the prior art.
Figure 4:
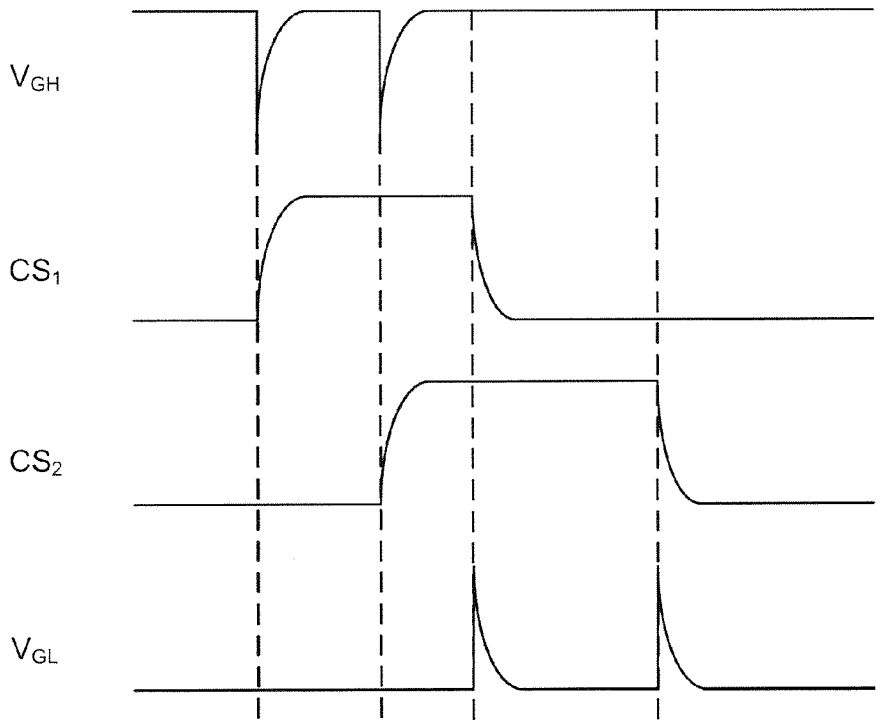
FIG. 4 shows a schematic diagram of the pulses of the control signals according to the present invention.

Please refer to FIG. 4, which shows a schematic diagram of the pulses of the control signals according to the present invention. As shown in the figure, in the architecture of the present invention, the stabilizing capacitors $C_{R1}$, $C_{R2}$ can have small capacitance. Thereby, the stabilizing capacitors $C_{R1}$, $C_{R2}$ can be disposed in the driving chip 20 without external capacitors (as opposed to disposing on the FPC 50 in FIG. 1 according to the prior art). Alternatively, the stabilizing capacitors $C_{R1}$, $C_{R2}$ are not required and thus achieving the purpose of saving circuit area. In addition, because the plurality of signal generating units 201 and the scan control circuit 401 have respective supply power sources (as shown in FIG. 2), when the voltage levels of the driving voltages $V_{GH}$, $V_{GL}$ change (the voltage levels decrease) as a result of changes in loading, the plurality of control signals $CS_1$~$CS_n$ will not be influenced. As shown in the figure, when the driving voltage $V_{GH}$ decreases abruptly or the driving voltage $V_{GL}$ increases abruptly, the plurality of control signals $CS_1$~$CS_n$, will not be influenced; instead, they will remain on the same levels.

Figure 5:
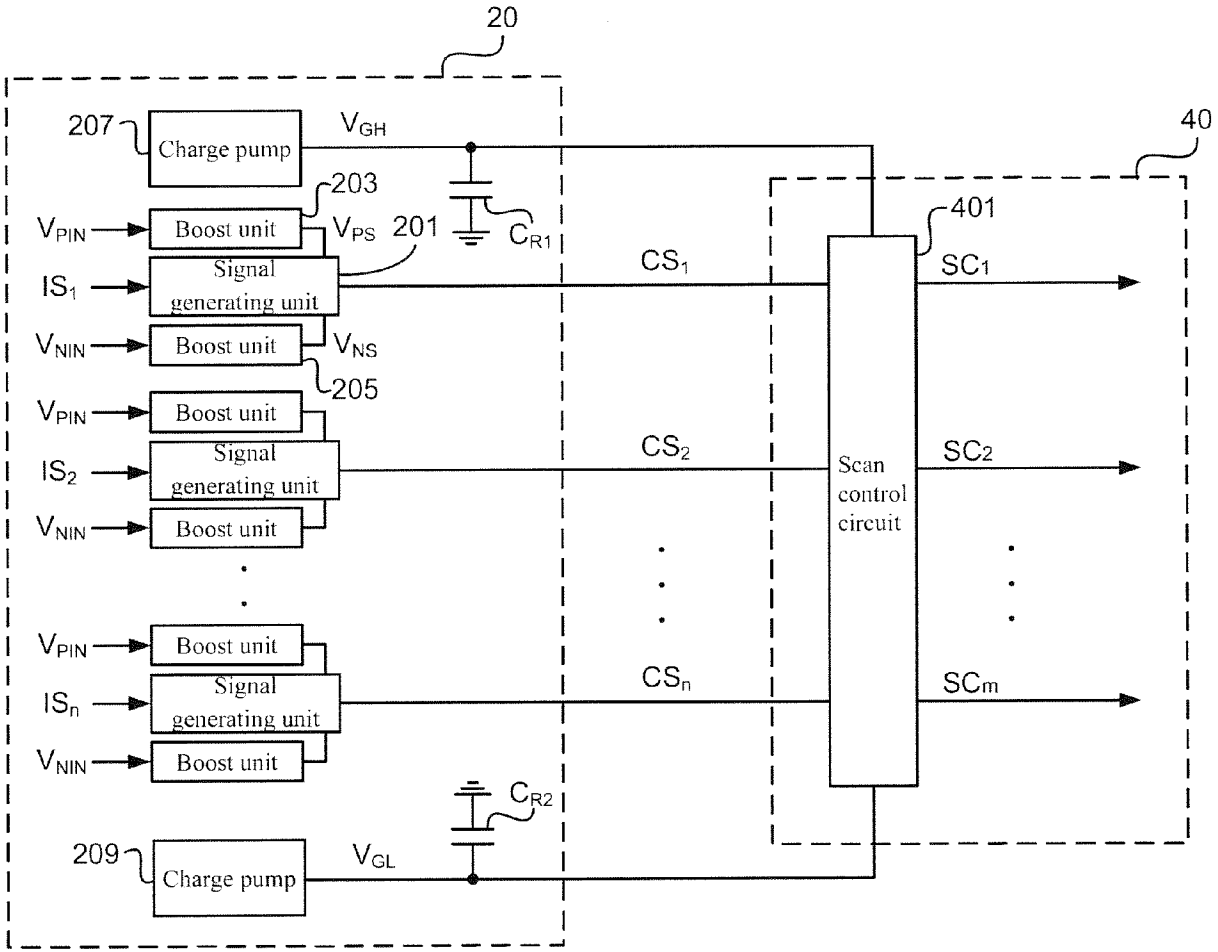
FIG. 5 shows a schematic diagram of the driving circuit of the display panel according to the second embodiment of the present invention.

Please refer to FIG. 5, which shows a schematic diagram of the driving circuit of the display panel according to the second embodiment of the present invention. The difference between the present embodiment and the previous one is that, according to the previous embodiment, a power generating module (the boost units 203, 205) provides the supply power sources to the plurality of signal generating units 201 simultaneously. By contrast, according to the present embodiment, a plurality of power generating modules provide supply power sources to the plurality of signal generating units 201, respectively. The rest is the same as the previous embodiment. Hence, the details will not be described again.

According to the present embodiment, each scan driving circuit 201 is coupled to a power generating module (the boost units 203, 205), respectively, and receives the supply power source (the supply voltages $V_{PS}$, $V_{NS}$) generated by each of the power generating module (the boost units 203, 205), respectively, as the supply power source for generating the control signals $CS_1$~$CS_n$, respectively.

Each of the power generating module (the boost units 203, 205) receives the same input power source (the input voltages $V_{PIN}$, $V_{NIN}$) as the power source for generating the supply power source (the supply voltages $V_{PS}$, $V_{NS}$). In other words, the plurality of boost units 203 all receive the input voltage $V_{PIN}$ as the power source for generating the supply voltage $V_{PS}$; and the plurality of boost units 205 all receive the input voltage $V_{NIN}$ as the power source for generating the supply voltage $V_{NS}$.

According to the disposition of the present embodiment, like the previous embodiment, the required output power of the charge pumps 207, 209 can be reduced, which shrinks the size of the stabilizing capacitors $C_{R1}$, $C_{R2}$ or even allows removal of the stabilizing capacitors $C_{R1}$, $C_{R2}$ for reducing the circuit area and avoiding influence of variations in loading on the plurality of control signals $CS_1$~$CS_n$. Moreover, because each signal generating unit 201 owns an individual power generating module (the boost units 203, 205), when only some of the control signals $CS_1$~$CS_n$ are required, the corresponding power generating modules of the unnecessary signal generating units 201 can be shut off for saving power consumption. Alternatively, when the power source required by each signal generating unit 201 is different, the plurality of power generating modules can be endowed with different boosting capabilities for matching the corresponding signal generating units 201.

Figure 6:
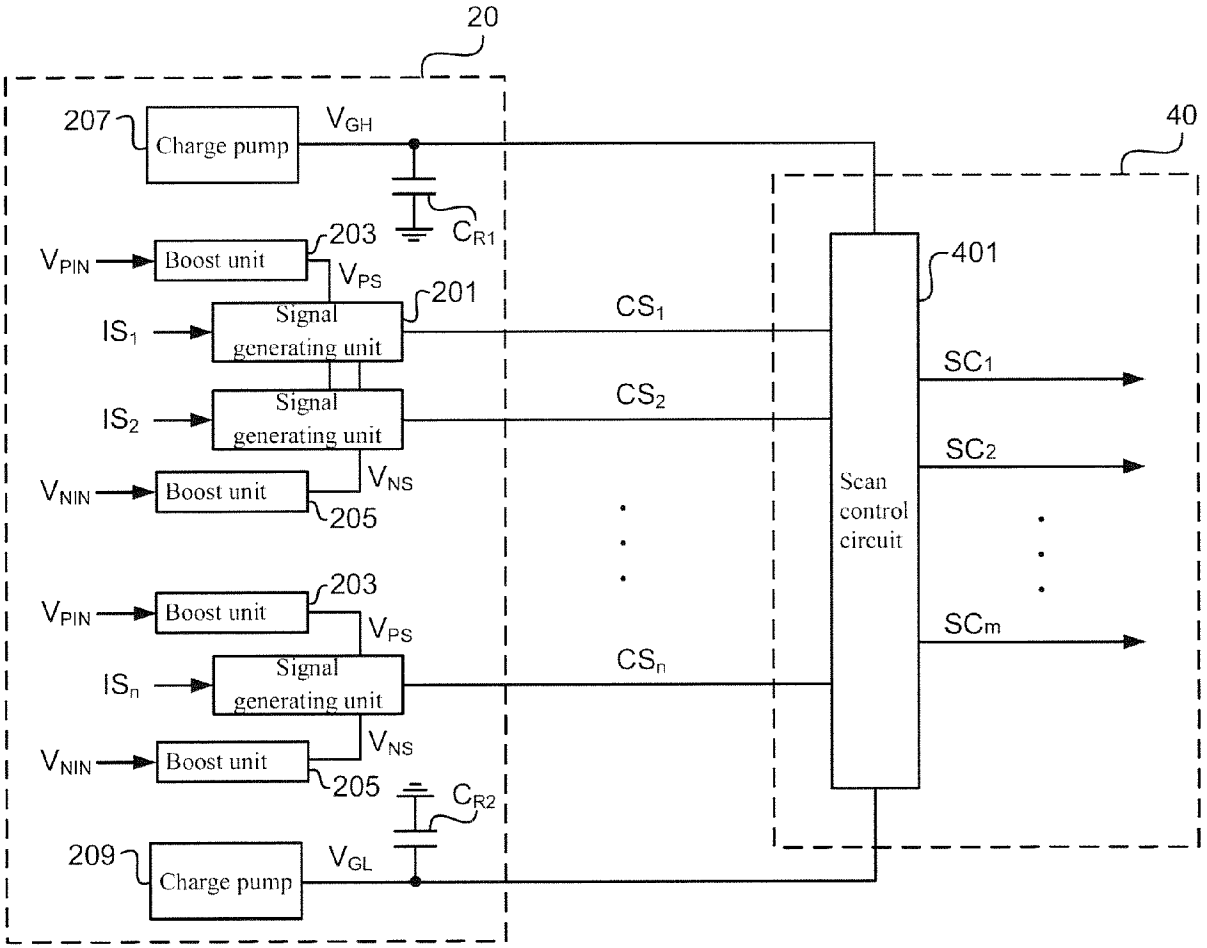
FIG. 6 shows a schematic diagram of the driving circuit of the display panel according to the third embodiment of the present invention.

In addition, the driving circuit for a display panel according to the present invention is not limited only to corresponding a power generating module (the boost units 203, 205) to all signal generating units 201 (FIG. 2) or corresponding a plurality of signal generating units 201 (FIG. 4) to a plurality of power generating modules, respectively. The driving circuit according to the present invention can further correspond to a plurality of power generating modules to a plurality of signal generating units 201, and the plurality of power generating modules can be coupled to different number of signal generating units 201, respectively. As shown in FIG. 6, which shows a schematic diagram of the driving circuit of the display panel according to the third embodiment of the present invention, the first power generating module (the boost unit 203, 205) provides the supply voltages $V_{PS}$, $V_{NS}$ to two signal generating units 201; the second power generating module provides the supply voltages $V_{PS}$, $V_{NS}$ to one signal generating unit 201.

Furthermore, in FIG. 5 and FIG. 6, it is not required that the output of the driving chip 20 used for outputting the driving voltages $V_{GH}$, $V_{GL}$ should be connected with the stabilizing capacitors $C_{R1}$, $C_{R2}$; it is not required that the path for outputting the driving voltages $V_{GH}$, $V_{GL}$ to the scan control circuit 401 by the driving chip 20 should be connected with the stabilizing capacitors $C_{R1}$, $C_{R2}$; or it is not required that the input of the scan control circuit 401 used for receiving the driving voltages $V_{GH}$, $V_{GL}$ should be connected with the stabilizing capacitors $C_{R1}$, $C_{R2}$.

Figure 7:
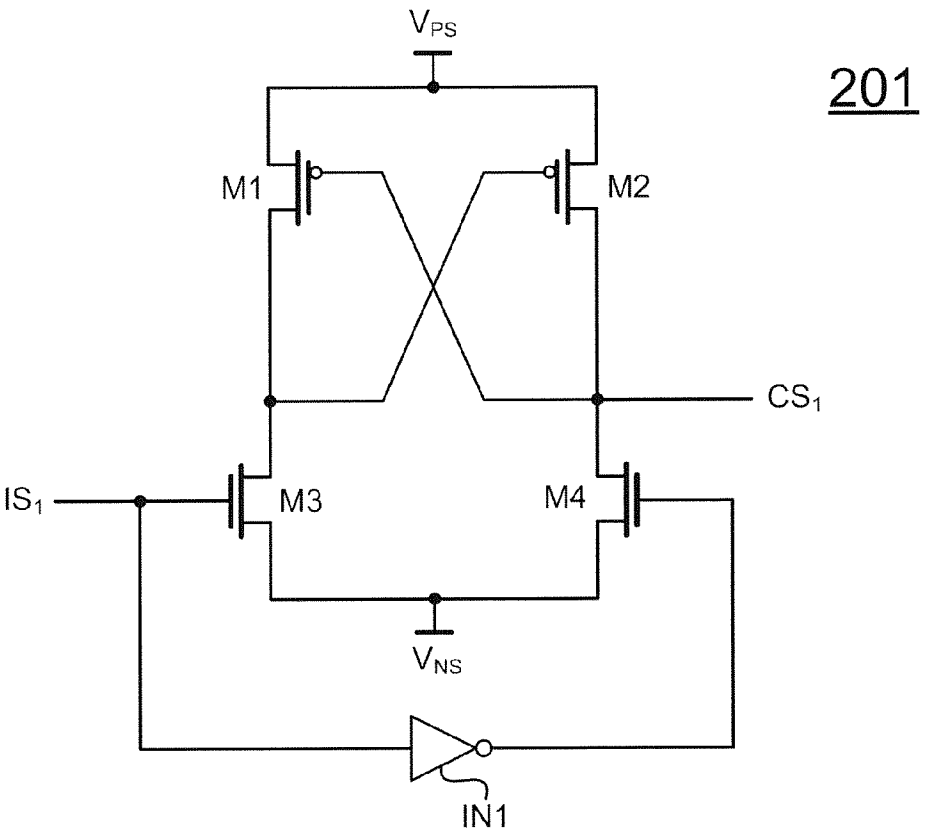
FIG. 7 shows a circuit diagram of the signal generating unit according to the first embodiment of the present invention.

Please refer to FIG. 7, which shows a circuit diagram of the signal generating unit according to the first embodiment of the present invention. As shown in the figure, because the architectures of the plurality of signal generating units 201 according to the present invention are identical, only the first signal generating units 201 is described according to the present embodiment. The signal generating unit 201 according to the present embodiment is a level shifter used for adjusting the level of the input signal $IS_1$ to the control signal $CS_1$ for outputting. The signal generating unit 201 comprises a plurality of P-type transistors M1, M2, a plurality of N-type transistors M3, M4, and an inverter IN1. A first terminal of the P-type transistor M1 is coupled a first terminal of the P-type transistor M2 and receives the supply voltage $V_{PS}$. A first terminal of the N-type transistor M3 is coupled a first terminal of the N-type transistor M4 and receives the supply voltage $V_{NS}$. A second terminal of the N-type transistor M3 is coupled to a second terminal of the P-type transistor M1 and a control terminal of the P-type transistor M2. A second terminal of the N-type transistor M4 is coupled to a second terminal of the P-type transistor M2 and a control terminal of the P-type transistor M1 for outputting the control signal $CS_1$. A control terminal of the N-type transistor M3 is coupled an input of the inverter IN1 and receives the input signal $IS_1$. A control terminal of the N-type transistor M4 is coupled to an output of the inverter IN1 and receives the inverted signal of the input signal $IS_1$ inverted by the inverter IN1.

Figure 8:
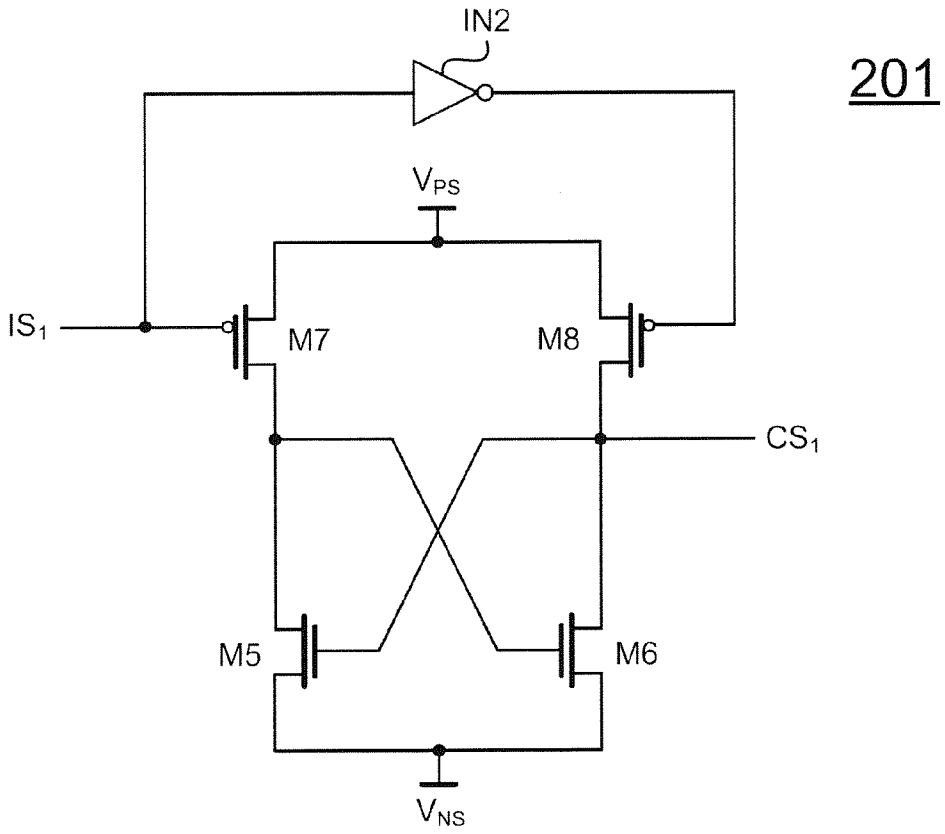
FIG. 8 shows a circuit diagram of the signal generating unit according to the second embodiment of the present invention.

Please refer to FIG. 8, which shows a circuit diagram of the signal generating unit according to the second embodiment of the present invention. As shown in the figure, the signal generating unit 201 according to the present embodiment is another type of level shifter used for adjusting the level of the input signal $IS_1$ to the control signal $CS_1$ for outputting. The signal generating unit 201 comprises a plurality of N-type transistors M5, M6, a plurality of P-type transistors M7, M8, and an inverter IN2. A first terminal of the N-type transistor M5 is coupled a first terminal of the N-type transistor M6 and receives the supply voltage $V_{NS}$. A first terminal of the P-type transistor M7 is coupled a first terminal of the P-type transistor M8 and receives the supply voltage $V_{PS}$. A second terminal of the P-type transistor M7 is coupled to a second terminal of the N-type transistor M5 and a control terminal of the N-type transistor M6. A second terminal of the P-type transistor M8 is coupled to a second terminal of the N-type transistor M6 and a control terminal of the N-type transistor M5 for outputting the control signal $CS_1$. A control terminal of the P-type transistor M7 is coupled an input of the inverter IN2 and receives the input signal $IS_1$. A control terminal of the P-type transistor M8 is coupled to an output of the inverter IN2 and receives the inverted signal of the input signal $IS_1$ inverted by the inverter IN2.

Figure 9:
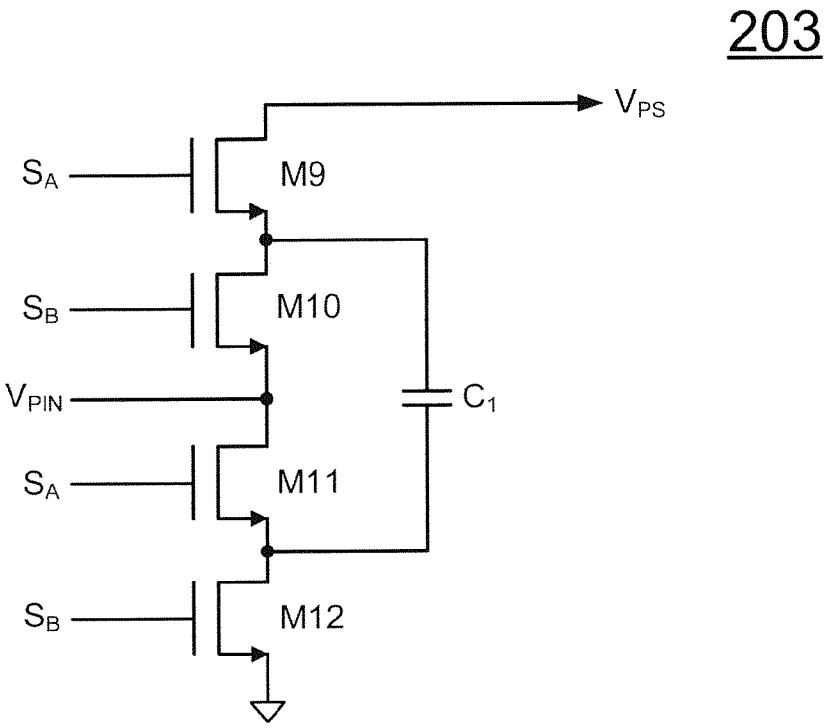
FIG. 9 shows a circuit diagram of the boost unit according to the first embodiment of the present invention.

Please refer to FIG. 9, which shows a circuit diagram of the boost unit according to the first embodiment of the present invention. As shown in the figure, the boost units according to the present embodiment are charge pumps. Because the circuit architectures of the plurality of boost units 203, 205 can be identical, in the following, the boost unit 203 is used for description. The boost unit 203 comprises a plurality of transistors M9~M12 and a charging capacitor $C_1$. A first terminal of the transistor M9 is coupled to the signal generating unit 201. A first terminal of the transistor M10 is coupled a second terminal of the transistor M9 and a first terminal of the charging capacitor $C_1$. A first terminal of the transistor M11 is coupled to a second terminal of the transistor M10. A first terminal of the transistor M12 is coupled a second terminal of the transistor M11 and a second terminal of the charging capacitor $C_1$. A second terminal of the transistor M12 is coupled to a ground. The second terminal of the transistor M10 and the first terminal of the transistor M11 receive the input voltage $V_{PIN}$. The transistors M9, M11 are controlled by a switching signal $S_A$ for switching; the transistors M10, M12 are controlled by a switching signal $S_B$ for switching. Besides, the switching signals $S_A$, $S_B$ are mutually inverse signals.

Initially, the level of the switching signal $S_A$ is low; the level of the switching signal $S_B$ is high; the transistors M9, M11 are cut off; and the transistors M10, M12 are turned on. The input voltage $V_{PIN}$ is transmitted to the first terminal of the charging capacitor $C_1$ via the transistor M10; the second terminal of the charging capacitor $C_1$ is coupled to the ground via the transistor M12. Thereby, the charging capacitor $C_1$ will be charged to the level of the input voltage $V_{PIN}$.

After the charging is completed, the level of the switching signal $S_A$ is changed to high, the level of the switching signal $S_B$ is changed to low, M9, M11 are turned on, and the transistors M10, M12 are cut off. The input voltage $V_{PIN}$ is transmitted to the second terminal of the charging capacitor $C_1$ via the transistor M11; the first terminal of the charging capacitor $C_1$ is coupled to the signal generating unit 201 via the transistor M9. Thereby, the input voltage $V_{PIN}$ is added to the voltage level across the charging capacitor $C_1$ via the transistor M11. The added voltage is transmitted to the signal generating unit 201 and used as the supply voltage $V_{PS}$. Accordingly, the boost unit 203 according to the present embodiment is a double charge pump.

Figure 10:
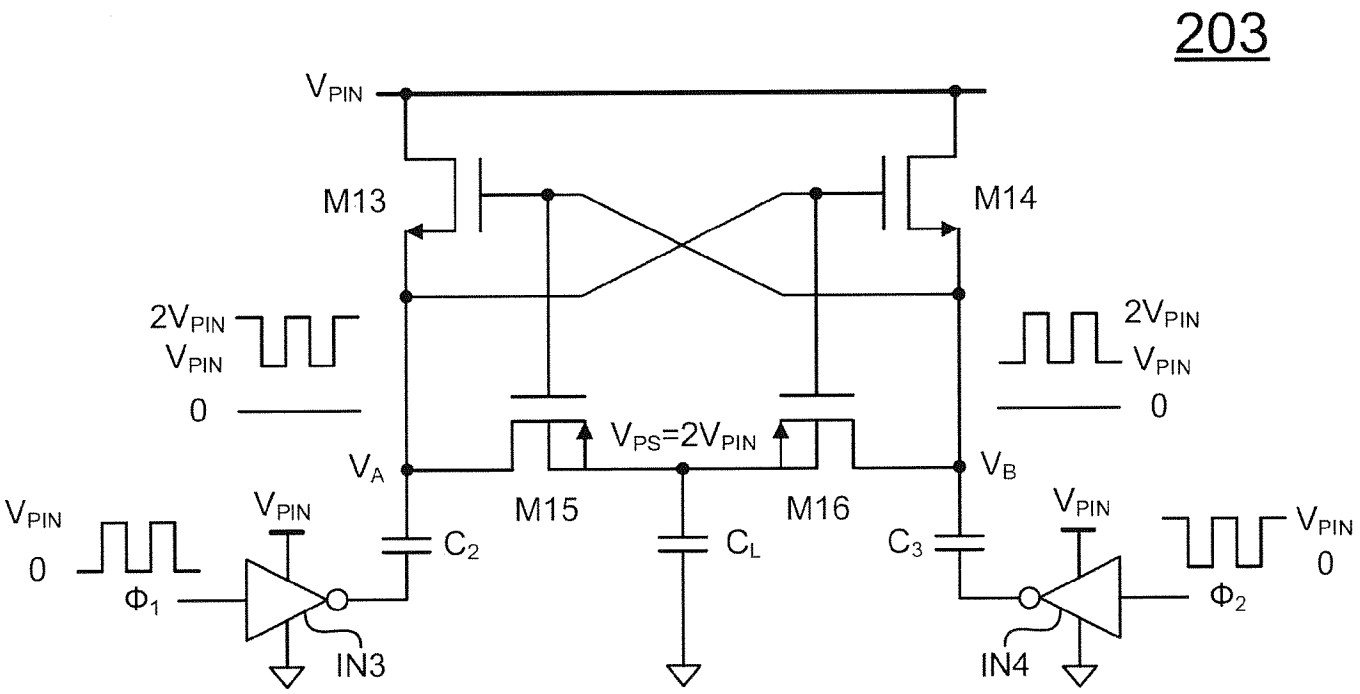
FIG. 10 shows a circuit diagram of the boost unit according to the second embodiment of the present invention.

Please refer to FIG. 10, which shows a circuit diagram of the boost unit according to the second embodiment of the present invention. As shown in the figure, the boost unit 203 according to the present embodiment is another type of charge pump, which comprises a plurality of transistors M13~M16, a plurality of charging capacitors $C_2$~$C_3$, a plurality of inverters IN3~IN4 and an output capacitor $C_L$. First terminals of the transistors M13, M14 both receive the input voltage $V_{PIN}$. A first terminal of the transistor M15 is coupled to a second terminal of the transistor M13 and a control terminal of the transistor M15. A control terminal of the transistor M15 is coupled to a control terminal of the transistor M13 and a second terminal of the transistor M14. A first terminal of the transistor M16 is coupled to the second terminal of the transistor M14 and the control terminal of the transistor M13. A control terminal of the transistor M16 is coupled to the control terminal of the transistor M14 and the second terminal of the transistor M13. The charging capacitor $C_2$ is coupled between the second terminal of the transistor M13 and an output of the inverter IN3. An input of the inverter IN3 receives a clock signal $\Phi_1$. A power terminal of the inverter IN3 receives the input voltage $V_{PIN}$. The charging capacitor $C_3$ is coupled between the second terminal of the transistor M14 and an output of the inverter IN4. An input of the inverter IN4 receives a clock signal $\Phi_2$. A power terminal of the inverter IN4 receives the input voltage $V_{PIN}$.

In the boost unit 203 according to the present embodiment, the input voltage $V_{PIN}$ is input to the first terminals of the transistors M13, M14. By using the mutually inverted clock signals having the same high-level voltage as the input voltage $V_{PIN}$, the input voltage $V_{PIN}$ is output to the charging capacitors $C_2$, $C_3$ via the inverters IN3, IN4, respectively. Thereby, the voltage level of the nodes $V_A$, $V_B$ are between the input voltage $V_{PIN}$ and twice the input voltage $V_{PIN}$. In addition, the capacitor $C_L$ is charged alternately by the transistors M15, M16 to twice the input voltage $V_{PIN}$, which is used as the supply voltage $V_{PS}$.

Figure 11:
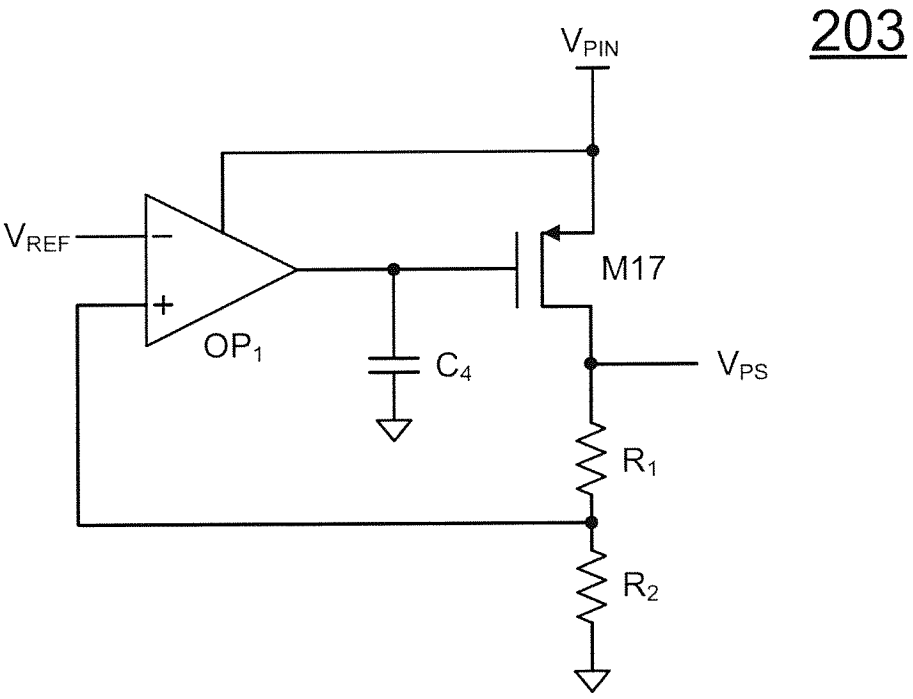
FIG. 11 shows a circuit diagram of the boost unit according to the third embodiment of the present invention.

Please refer to FIG. 11, which shows a circuit diagram of the boost unit according to the third embodiment of the present invention. As shown in the figure, the boost unit 203 according to the present embodiment is an LDO, which comprises an operational amplifier $OP_1$, a capacitor $C_4$, a transistor M17, and a plurality of resistors $R_1$, $R_2$. A negative input of the operational amplifier $OP_1$ receives a reference voltage $V_{REF}$. A power terminal of the operational amplifier $OP_1$ receives the input voltage $V_{PIN}$. The capacitor $C_4$ is coupled between an output of the operational amplifier $OP_1$ and the reference voltage terminal. A control terminal of the transistor M17 is coupled to the output of the operational amplifier $OP_1$. A first terminal of the transistor M17 receives the input voltage $V_{PIN}$. The resistor $R_1$ is coupled between a second terminal of the transistor M17 and a positive input of the operational amplifier $OP_1$. The resistor $R_2$ is coupled between the positive input of the operational amplifier $OP_1$ and the reference voltage terminal. In addition, the second terminal of the transistor M17 is also coupled to the output of the boost unit 203 for outputting the supply voltage $V_{PS}$.

According to the above description, the boost unit 203 according to the present embodiment can be the LDO described above, which converts the input voltage $V_{PIN}$ into the supply voltage $V_{PS}$ and outputs it stably. The operational principle of an LDO is well known to a person having ordinary skill in the art. Hence, the details will not be described further.

Figure 12:
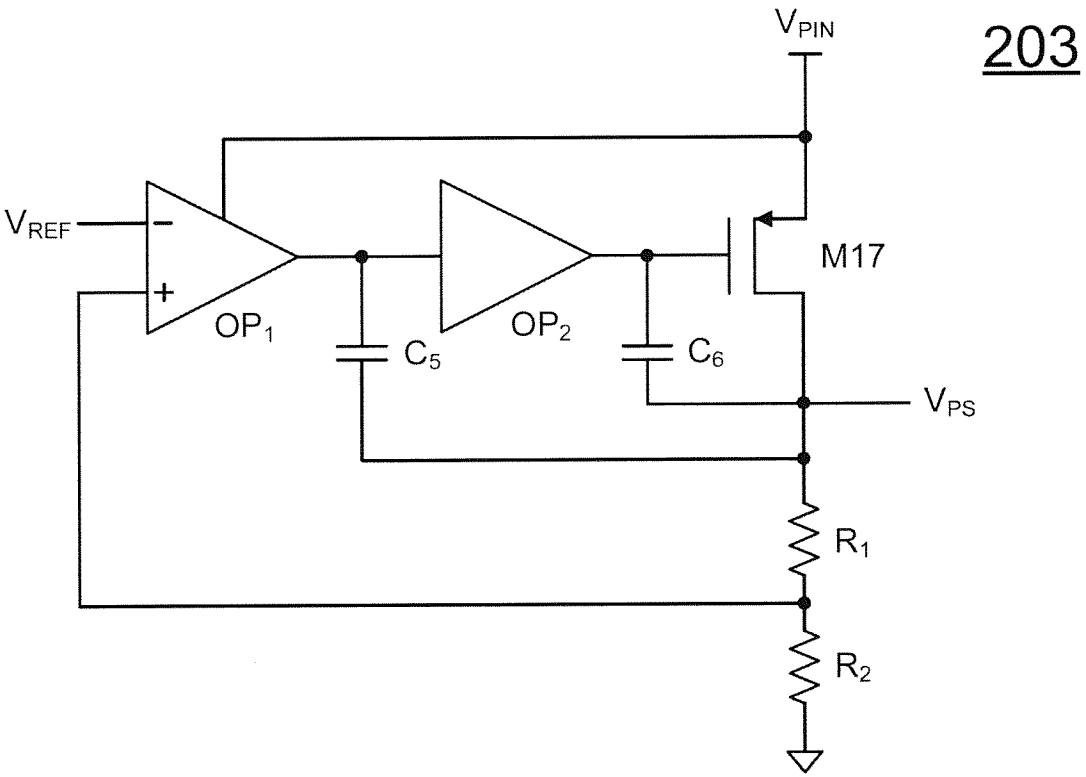
FIG. 12 shows a circuit diagram of the boost unit according to the fourth embodiment of the present invention.

Please refer to FIG. 12, which shows a circuit diagram of the boost unit according to the fourth embodiment of the present invention. As shown in the figure, the boost unit 203 according to the present embodiment is another type of LDO. The difference between the LDO according to the present embodiment and the one according to the previous embodiment is that the former further comprises an operational amplifier $OP_2$ and a plurality of capacitors $C_5$, $C_6$; the rest is the same as the one according to the previous embodiment. The capacitor $C_5$ is coupled between the output of the operational amplifier $OP_1$ and the second terminal of the transistor M17. An input of the operational amplifier $OP_2$ is coupled to the output of the operational amplifier $OP_1$. An output of the operational amplifier $OP_2$ is coupled to the control terminal of the transistor M9. The capacitor $C_6$ is coupled between the output of the operational amplifier $OP_2$ and the second terminal of the transistor M17. The power generating circuit according to the present embodiment, like the one according to the previous embodiment, can also convert the input voltage $V_{PIN}$ into the supply voltage $V_{PS}$ and outputs it stably.

Moreover, in addition to applicable to the boost units 203, 205, the boost units in FIGS. 9 to 12 can be further used as the circuits for generating the input power source (the input voltages $V_{PIN}$, $V_{NIN}$) or for the charge pumps 207, 209.

Figure 13B:
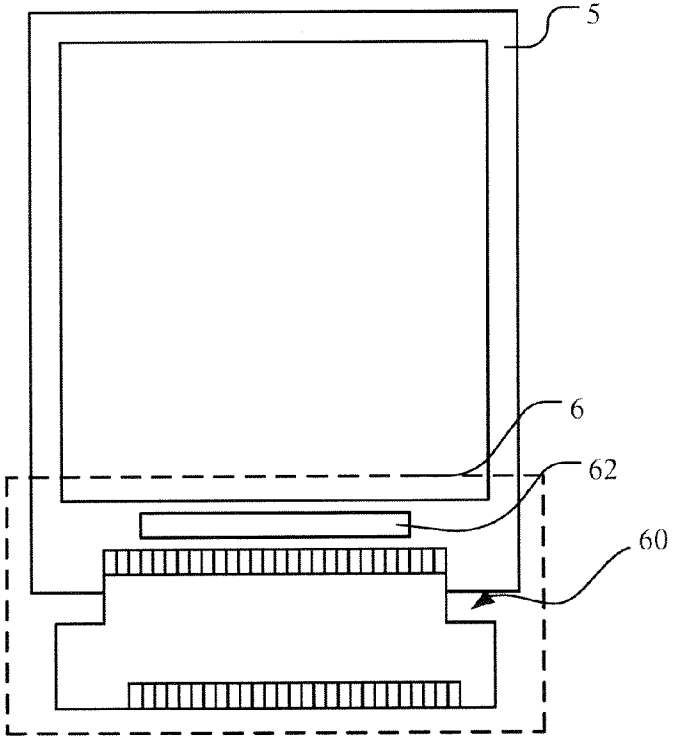
FIG. 13B shows a structural schematic diagram of the display device according to the present invention.
Figure 13A:
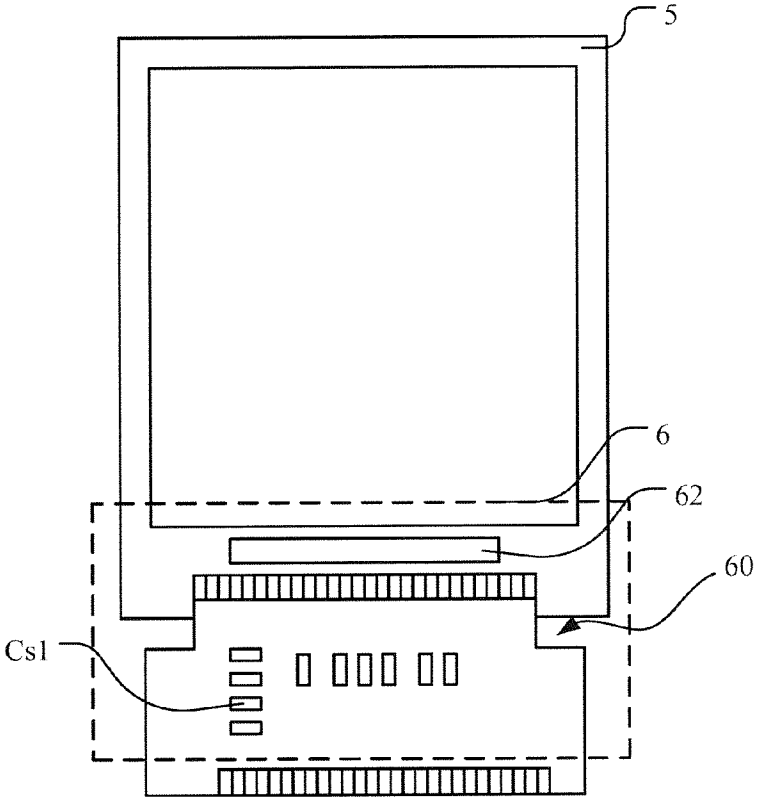
FIG. 13A shows a structural schematic diagram of the display device.

Please refer to FIG. 13A, which shows a structural schematic diagram of the display device. As shown in the figure, the display device comprises the display panel 5 and a driving module 6. The driving module 6 is connected electrically with the display panel 5 for driving the display panel 5 to display images. The driving module 6 comprises an FPC 60 and a driving chip 62. The driving chip 62 is disposed on one side of the display panel 5 and connected with the display panel 5. One side of the FPC 60 is connected to one side of the display panel 5 and connected electrically with the driving chip 62. According to the embodiment, the storage capacitor Csl is connected externally to the FPC 60.

Please refer to FIG. 13B, which shows a structural schematic diagram of the display device according to the present invention. As shown in the figure, the difference between the present embodiment and the one in FIG. 13A is that the driving chip 62 according to the present embodiment comprises the power generating module, the power generating circuit, and the plurality of signal generating units 201. The connection and operations of the power generating module, the power generating circuit, and the plurality of signal generating units 201 are already described above. Hence, the details will not be repeated. Because the plurality of signal generating units 201 and the scan control circuit 401 according to the present embodiment use the supply voltage $V_{PS}$, $V_{NS}$ and the driving voltages $V_{GH}$, $V_{GL}$ provided by the power generating module and the power generating circuit, respectively, the size of the voltage-stabilizing capacitors $C_{R1}$, $C_{R2}$ required by the driving chip 62 can be shrunk drastically. Alternatively, the driving chip 62 (namely, the driving circuit) even requires no external storage capacitor, and thus achieving the purposes of saving circuit area as well as costs.

Figure 14:
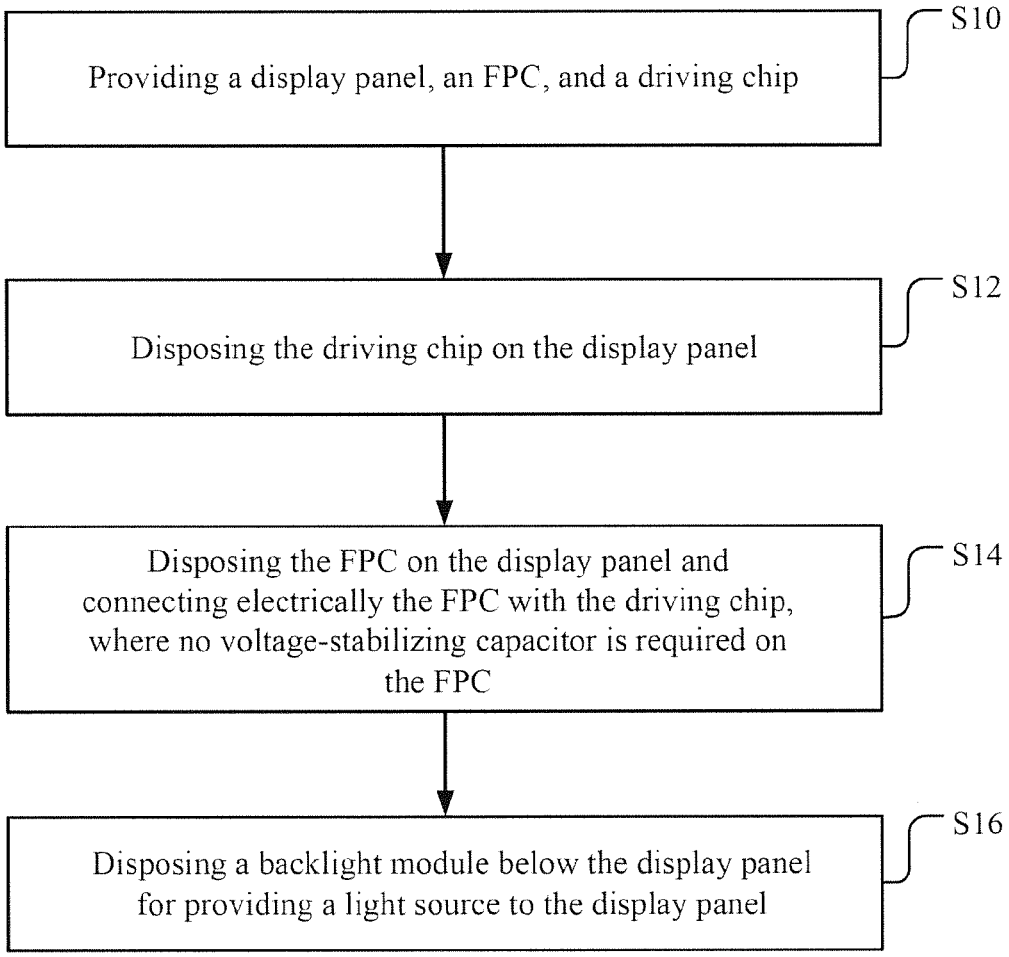
FIG. 14 shows a flowchart of the method for manufacturing the display panel.

Please refer to FIG. 14, which shows a flowchart of the method for manufacturing the display panel. As shown in the figure, the method for manufacturing the display panel according to the present invention comprises the following steps. First, the step S10 is executed for providing a display panel 5, an FPC 60, and a driving chip 62. Next, the step S12 is executed for disposing the driving chip 62 on the display panel 62, as shown in FIG. 13A. Afterwards, the step S14 is executed for disposing the FPC 60 on the display panel 5 and connecting electrically the FPC 60 with the driving chip 62. According to the present method, no voltage-stabilizing capacitor $C_{R1}$, $C_{R2}$ is required on the FPC 60, as shown in FIG. 13B.

Based on the above description, because the plurality of signal generating units 201 and the scan control circuit 401 according to the present embodiment use the driving voltages $V_{GH}$, $V_{GL}$ and the supply voltage $V_{PS}$, $V_{NS}$ provided by the power generating module and the power generating circuit, respectively, the size of the voltage-stabilizing capacitors $C_{R1}$, $C_{R2}$ required by the driving chip 62 can be shrunk drastically and hence allowing direct disposal in the driving chip 62 and requiring no external voltage-stabilizing capacitors $C_{R1}$, $C_{R2}$ on the FPC 60. Alternatively, the driving chip 62 (namely, the driving circuit) even requires no external voltage-stabilizing capacitors $C_{R1}$, $C_{R2}$. Consequently, according to the present invention the process step of disposing the voltage-stabilizing capacitors $C_{R1}$, $C_{R2}$ externally on the FPC 60 can be omitted, and thus shortening the process time as well as reducing costs.

Besides, the method for manufacturing a display panel according to the present invention further comprises a step S16 for disposing a backlight module (not shown in the figure) below the display panel 5 for providing a light source to the display panel 5.

To sum up, according to the driving circuit for a display panel of the present invention, the power generating module and the power generating circuit provide the power sources for the plurality of signal generating units and the scan control circuit, respectively, for reducing the required output power of the power generating circuit and thus further reducing the required capacitance of the voltage-stabilizing capacitors coupled to the output of the power generating circuit. Thereby, the size of the voltage-stabilizing capacitors can be shrunk and integrated in the scan driving circuit. Alternatively, the voltage-stabilizing capacitors are even not required for reducing the circuit area. In addition, by not sharing the power sources of the plurality of signal generating units and the scan control circuit, the influence on the plurality of control signals of the plurality of signal generating units as the loading changes can be avoided.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit for a display panel, comprising:

a power generating module, receiving an input power source, and generating at least a supply power source according said input power source;

a plurality of signal generating units, coupled to said power generating module, and generating a plurality of control signals according to said supply power source and a plurality of input signals;

a power generating circuit, generating at least a driving power source; and a scan control circuit, coupled to said power generating circuit and said plurality of signal generating units, and generating a plurality of scan signals according to said driving power source and at least one of said plurality of control signals;

wherein the driving circuit generates the scan signals in response to the power generating module, said power generating circuit doesn't output said driving power source to said signal generating units, an input of said scan control circuit used for receiving said driving power source requires no voltage-stabilizing capacitor.

2. The driving circuit of claim 1, wherein said power generating module comprises:

a first boost unit, receiving a first input voltage of said input power source, and generating a first supply voltage by boosting said first input voltage; and a second boost unit, receiving a second input voltage of said input power source, and generating a second supply voltage by boosting said second input voltage;

where said plurality of signal generating units generate said plurality of control signals according to said plurality of input signals, said first supply voltage, and said second supply voltage.

3. The driving circuit of claim 1, wherein said power generating circuit comprises:

a first charge pump, used for generating a first driving power source, and transmitting said first driving power source to said scan control circuit; and a second charge pump, corresponding to said first charge pump, generating a second driving power source, and transmitting said second driving power source to said scan control circuit.

4. The driving circuit of claim 1, and further comprising at least one said voltage-stabilizing capacitor coupled to said power generating circuit and used for stabilizing the voltage of said driving power source.

5. The driving circuit of claim 4, wherein said power generating module, said plurality of signal generating units, said power generating circuit, and said voltage-stabilizing capacitor are disposed in a driving chip.

6. The driving circuit of claim 1, wherein said power generating module, said plurality of signal generating units, and said power generating circuit are disposed in a driving chip.

7. The driving circuit of claim 6, wherein said an output of said driving chip requires no said voltage-stabilizing capacitor.

8. The driving circuit of claim 6, wherein a connection path is between said driving chip and said scan control circuit, and said connection path requires no said voltage-stabilizing capacitor connected thereon.

9. A driving circuit for a display panel, comprising:

a plurality of power generating modules, receiving an input power source, and generating a plurality of supply power sources according said input power source;

a plurality of signal generating units, coupled to said plurality of power generating modules, and generating a plurality of control signals according to said plurality of supply power sources and a plurality of input signals;

a power generating circuit, generating at least a driving power source; and a scan control circuit, coupled to said power generating circuit and said plurality of signal generating units, and generating a plurality of scan signals according to said driving power source and at least one of said plurality of control signals;

wherein the driving circuit generates the scan signals in response to the power generating modules, said power generating circuit doesn't output said driving power source to said signal generating units, an input of said scan control circuit used for receiving said driving power source requires no voltage-stabilizing capacitor.

10. The driving circuit of claim 9, wherein said plurality of power generating modules are coupled to said signal generating units, respectively.

11. The driving circuit of claim 9, wherein said plurality of power generating modules, respectively, comprise:

a first boost unit, receiving a first input voltage of said input power source, and generating a first supply voltage by boosting said first input voltage; and a second boost unit, receiving a second input voltage of said input power source, and generating a second supply voltage by boosting said second input voltage;

where at least one of said plurality of signal generating units generates at least one of said plurality of control signals according to at least one of said plurality of input signals, said first supply voltage, and said second supply voltage.

12. The driving circuit of claim 9, and further comprising at least one said voltage-stabilizing capacitor coupled to said power generating circuit and used for stabilizing the voltage of said driving power source.

13. A driving module for a display panel, comprising:

a flexible printed circuit, connected electrically with said display panel; and a driving chip, disposed on one side of said flexible printed circuit, and comprising:

a power generating module, receiving an input power source, and generating a supply power source according said input power source;

a plurality of signal generating units, coupled to said power generating module, and generating a plurality of control signals according to said supply power source and a plurality of input signals;

a power generating circuit, generating a driving power source; and a scan control circuit, coupled to said power generating circuit and said plurality of signal generating units, and generating a plurality of scan signals according to said driving power source and at least one of said plurality of control signals;

wherein the driving module generates the scan signals in response to the power generating module, said power generating circuit doesn't output said driving power source to said signal generating units, an input of said scan control circuit used for receiving said driving power source requires no voltage-stabilizing capacitor.

14. The driving module of claim 13, and further comprising at least one said voltage-stabilizing capacitor coupled to said power generating circuit and used for stabilizing the voltage of said driving power source.

15. The driving module of claim 13, wherein said power generating module, said plurality of signal generating units, and said power generating circuit are disposed in a driving chip, and said flexible printed circuit requires no said voltage-stabilizing capacitor.

16. A display device, comprising:

a display panel, used for display an image;

a flexible printed circuit, connected electrically with said display panel; and a driving chip, disposed on one side of said flexible printed circuit, generating a plurality of scan signals to said display panel for displaying said image, and comprising:

a power generating module, receiving an input power source, and generating a supply power source according said input power source;

a plurality of signal generating units, coupled to said power generating module, and generating a plurality of control signals according to said supply power source and a plurality of input signals;

a power generating circuit, generating a driving power source; and a scan control circuit, coupled to said power generating circuit and said plurality of signal generating units, and generating a plurality of scan signals according to said driving power source and at least one of said plurality of control signals;

wherein the driving chip generates the scan signals in response to the power generating module, said power generating circuit doesn't output said driving power source to said signal generating units, an input of said scan control circuit used for receiving said driving power source requires no voltage-stabilizing capacitor.

17. The display device of claim 16, and further comprising at least one said voltage-stabilizing capacitor coupled to said power generating circuit and used for stabilizing the voltage of said driving power source.

18. The display device of claim 16, wherein said power generating module, said plurality of signal generating units, and said power generating circuit are disposed in a driving chip, and said flexible printed circuit requires no said voltage-stabilizing capacitor.

19. A method for manufacturing a display device, comprising steps of:

providing a display panel, a flexible printed circuit, and a driving chip;

disposing said driving chip on said display panel; and disposing said flexible printed circuit on said display panel and connecting electrically said flexible printed circuit with said driving chip;

where no voltage-stabilizing capacitor is required on said flexible printed circuit, a power generating circuit of said driving chip doesn't output a driving power source to a plurality of signal generating units of said driving chip, an input of a scan control circuit of said driving chip used for receiving said driving power source requires no said voltage-stabilizing capacitor.

20. The method for manufacturing a display device of claim 19, and further comprising a step of disposing a backlight module below said display panel for providing a light source to said display panel.

* * * * *